United States Patent [19]

Gillette

[11] 3,995,400

[45] Dec. 7, 1976

[54] HONING TOOL SLOT LINER AND ABRASIVE RETAINER

[75] Inventor: Robert H. Gillette, Angola, Ind.

[73] Assignee: Results Engineering, Inc., Angola, Ind.

[22] Filed: May 7, 1975

[21] Appl. No.: 575,149

[52] U.S. Cl. ..... 51/338; 51/344; 51/346

[51] Int. Cl.[2] ..... B24B 33/08

[58] Field of Search ..... 51/330, 331, 338–351, 51/204

[56] References Cited

UNITED STATES PATENTS

| | | | |
|---|---|---|---|
| 1,886,584 | 11/1932 | Prange | 51/347 |
| 2,201,593 | 5/1940 | Prange | 51/350 |
| 2,952,952 | 9/1960 | Stanhope | 51/204 |
| 3,109,266 | 11/1963 | Engle | 51/346 |
| 3,403,481 | 12/1968 | McDonald | 51/338 X |
| 3,861,091 | 1/1975 | McDonald | 51/331 |

*Primary Examiner*—Al Lawrence Smith
*Assistant Examiner*—Nicholas P. Godici
*Attorney, Agent, or Firm*—Gust, Irish, Jeffers & Rickert

[57] ABSTRACT

A honing tool slot protecting bushing is disclosed for gripping an abrasive element while mechanically isolating the abrasive element from the remainder of the honing tool. The slot liner is in the form of a bushing having four interconnected wall portions extending generally parallel to one another and including either a lip arrangement or a threaded fastener arrangement for holding the bushing fixedly within the body of the honing tool. The abrasive element is supported by the bushing and retained therein due to the frictional forces between the abrasive element and the bushing.

13 Claims, 8 Drawing Figures

HONING TOOL SLOT LINER AND ABRASIVE RETAINER

BACKGROUND OF THE INVENTION

The present invention relates to honing tools and more especially to apparatus and techniques for supporting abrasive elements within honing tool bodies.

Honing is a process where through numerous reciprocating and rotating passes a relatively small amount of material is removed from a surface by means of abrasive elements. The abrading action occurs over a wide surface area rather than on a line of contact as in a grinding operation. The honing tool itself comprises a holding device or body containing several generally oblong abrasive elements arranged in a circular pattern in which abrasive elements are forced against a workpiece by a wedging action, for example, of expander plates forcing those elements outwardly. Such reciprocable and rotatable honing tools carrying these circumferentially spaced abrasive elements or honing stones have been utilized for many years to hone cylindrical bores in workpieces such as for example the cylindrical bores for internal combustion engines. Heretofore, various means have been utilized for mounting and retaining abrasive elements in such honing tools and for the purpose of insulating the honing tool body from wear generated by pressure and motion of the abrasive element in the honing tool slot. The abrasive elements have been mounted in plastic, aluminum, diecastings and even paper in attempts to overcome the retention problem and minimize wear in the tool body. Exemplary of the prior art attempts is my prior U.S. Pat. No. 3,810,333. A further highly undesirable feature of the current honing art is the high noise level generated by honing tools. These innovations utilizing plastic, aluminum and paper, due to labor costs have a high unit cost factor. Therefore, one object of invention is to allow the use of abrasive made to size at a lessor cost figure.

SUMMARY OF THE INVENTION

Among the several objects of the present invention may be noted the provision of a bushing for isolating the two primary moving parts in each tool body slot to thereby reduce honing tool body wear; the provision of a nylon insert to firmly retain the abrasive elements in a honing tool; the provision of an improved honing tool which utilizes an abrasive stick merely cut to size thereby reducing abrasive costs; the provision of a nylon sleeve to surround both the abrasive element and its related steel expander to thereby absorb mechanical and sonic results of the cutting forces during a honing operation and substantially reducing the noise attendent to such processes; the provision of mechanical isolation between a honing tool body and abrasive elements; the provision of a slot liner to retain abrasive elements and to protect a honing tool body therefrom during a honing operation; the provision of a honing tool slot liner which is fixed or stationary relative to the tool body; and the provision of a scheme for supporting abrasive elements in a honing tool to extend the life of that honing tool; and the reduction of cost of a honing operation.

The foregoing as well as numerous other objects, features and advantages of the present invention are achieved by providing a honing tool slot protector in the form of a molded nylon shell that fits into and is retained in the tool body slot forming a tunnel through which the abrasive element being consumed and the mechanical means of feeding the abrasive elements travel. This totally isolates the honing tool body from wear, reduces noise and reduces abrasive costs by eliminating special abrasive elements supporting structures.

In general and in one form of the present invention, a structure for mounting and retaining individual abrasive elements in their respective honing tool body slots comprises a bushing fixed to the body within the slot and extending radially to simultaneous girdle at least a portion of the abrasive element and at least a portion of the pertaining expansion elements.

Also in general and in one form of the invention, a honing tool slot protector and abrasive retainer is fixedly supportable within a radially opening honing tool slot and comprises four interconnected wall portions extending generally parallel to one another and includes means for fixedly securing the slot protector and abrasive retainer within the honing tool slot either by a threaded fastener passing through apertures in the honing tool body and at least one of the wall portions or by providing at least one of those wall portions with a lip extending generally perpendicular to the wall portion and cooperating with a recess within the honing tool to prevent the radial outward movement of the slot protector.

BRIEF DESCRIPTION OF THE DRAWINGS

Corresponding reference characters indicate corresponding parts throughout the drawing and the following examples illustrate the invention but are not to be construed as limiting in any manner.

DESCRIPTION OF THE PREFERRED EMBODIMENT

Figure 1:
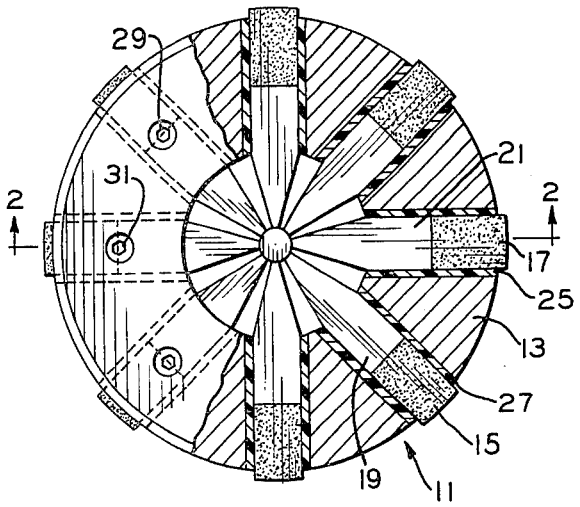
FIG. 1 is an end view partially in cross section of a honing tool incorporating one form of the present invention.
Figure 2:
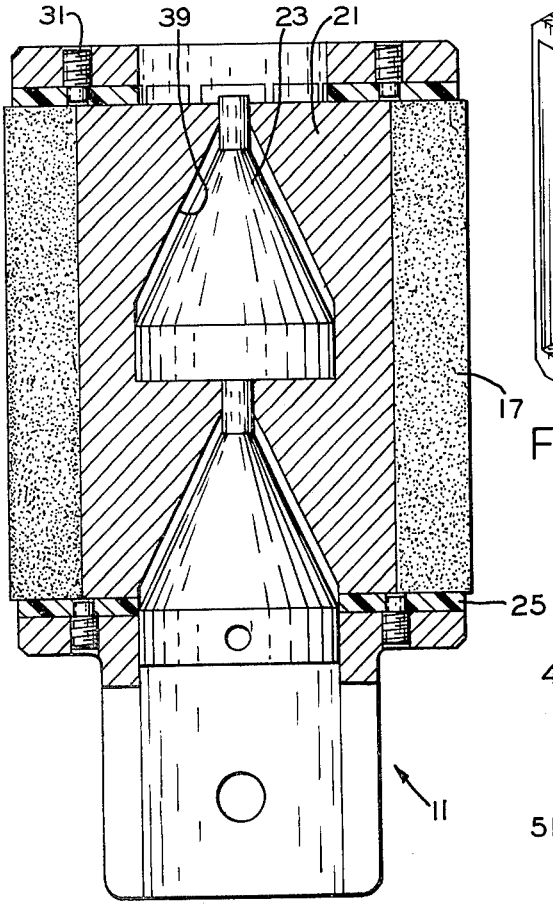
FIG. 2 is a cross section along the axis of the cylindrical body of the honing tool illustrated in FIG. 1.

Referring now to the drawing in greater detail there is indicated generally at 11 in FIGS. 1 and 2 a honing tool completely compatible with existing honing machinery yet illustrating the features and advantages of the present invention. The honing tool 11 has a cylindrical body portion 13 which is provided with a plurality of longitudinally extending outwardly opening radial slots as known in the prior art. Each slot contains an abrasive element 15 or 17 and an expander plate 19 or 21. The expander plates are selectively urged radially outwardly to thereby also force the abrasive elements radially outwardly by axial movement of the tapered expansion control element 23. The honing tool as thus far described is conventional.

Figure 3:
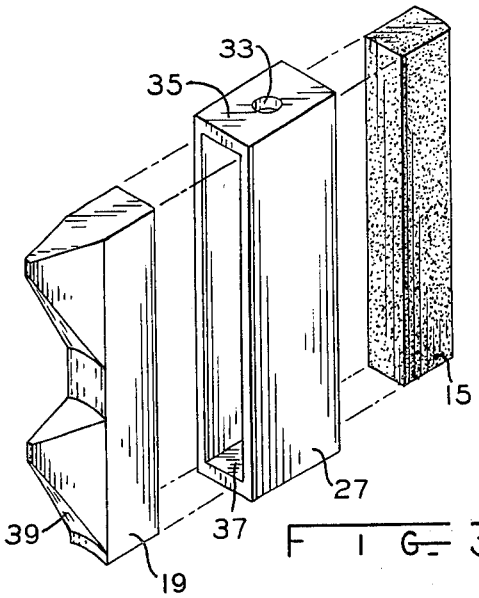
FIG. 3 is an exploded perspective view of a bushing, abrasive element, and expander plate suitable to be deployed in each of the longitudinally extending outwardly opening radial slots of the tool body of FIGS. 1 and 2.

Each of the radially opening honing tool slots contains a bushing or sleeve such as 25 and 27 with an exemplary bushing 27 depicted in greater detail in FIG. 3. The bushings or sleeves of FIGS. 1–3 are fixed or secured in an immovable manner in the honing tool body by exemplary Allen screws 29 and 31 or other similar threaded fasteners passing through the honing tool body and into apertures such as 33 in the bushing 27. Typically in one form of the invention the bushing 27 would be provided with such threaded fastener accepting apertures in each of its two opposed wall portions 35 and 37 as depicted in FIG. 2.

From FIG. 3 it may be seen that the unexpanded configuration of the bushing 27, abrasive element 15, and expander plate 19 would be such that the bushing simultaneously girdles at least a portion of each of the abrasive element and pertaining expander plate thereby isolating the abrasive element and expander plate from contact with the honing tool body 13.

Figure 4:
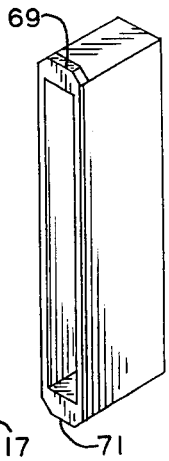
FIG. 4 is a perspective view of another bushing according to the present invention.
Figure 5:
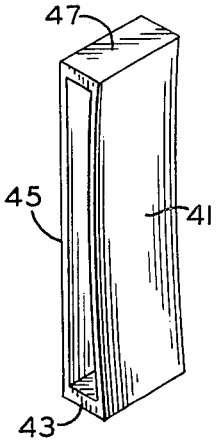
FIG. 5 is a perspective view of a further bushing according to the present invention.

In operation the honing tool is rotated about the axis of its generally cylindrical body while simultaneously executing numerous axial passes through the workpiece. As the abrasive elements wear the plug or plunger 23 is moved axially relative to the tool body 13 to force by way of tapered surfaces such as 39 the abrasive element radially outwardly. Of course, while double tapered surfaces are illustrated any number can be used depending on honing tool lengths and other design consideration. During rotation the abrasive elements such as 15 and 17 experience a centrifugal force and are held in position solely due to the frictional forces between individual abrasive elements and their pertaining bushings. These frictional forces may be accentuated if desired by employing structures such as illustrated in FIGS. 5–8. It will be noted that the bushings of FIGS. 3 and 4 have substantially rectangular inner and outer cross section configurations in a plane perpendicular to the direction of radial extension of the bushing whereas the structure in FIGS. 5–8 deviates from that rectangular cross section configuration slightly. In FIG. 5 variation from an exact rectangular interior cross section is achieved by bowing inwardly somewhat the wall portion 41 while the other three of the interconnected wall portions 43, 45 and 47 are substantially flat. Of course, all four interconnected wall portions extend generally parallel to one another in the radial direction of the tool and the resilient effect of the bowed wall portion 41 accentuates the frictional forces to securely grip the abrasive element.

Figure 8:
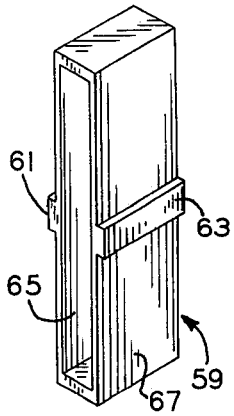
FIG. 8 is a perspective view of still another bushing according to the present invention.
Figure 6:
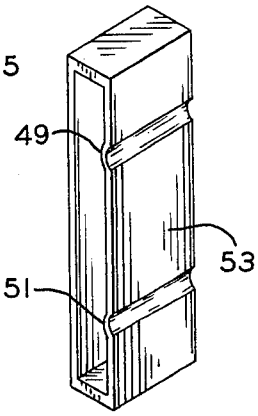
FIG. 6 is a perspective view of yet another bushing according to the present invention.
Figure 7:
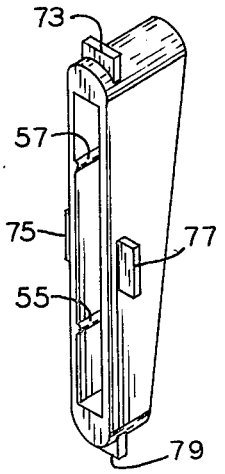
FIG. 7 is a perspective view of a still further bushing according to the present invention.

In FIGS. 6, 7 and 8 accentuation of the frictional forces is achieved by providing one or more ribs extending radially along the bushing. In FIG. 6 ribs 49 and 51 are formed in one wall portion simply as depressions inwardly of the surface of the wall portion 53. As an alternate additional material could be provided in the molded bushing to provide ribs 55 and 57 in FIG. 7. In FIG. 8 the frictional force between the bushing 59 and a pertaining or corresponding abrasive element would, depending on fit, be substantially the same as for the bushings illustrated in FIGS. 1–4. However, when the bushing 59 is placed into the slots of the cylindrical body portion 13 ribs 61 and 63 which extend radially along the outside surface of the bushing 59 cause the opposed walls 65 and 67 to be forced more firmly against the abrasive element thereby increasing the frictional forces holding the abrasive element within the tool.

Variations in the manner of securing the bushing within the honing tool slot are also possible. While threaded fasteners were employed in FIGS. 1–3 it is possible as depicted in FIGS. 4 and 7 to provide one or more lips or ears such as 69 and 71 for engaging corresponding recesses in the body portion 13 and when thus engaged the lips 69 and 71 prevent radially outward movement of the bushing relative to the body portion. In FIG. 4 the end of the bushing having the ears 69 and 71 would, of course, be radially inward from the opposite end. To allow the end viewed in FIG. 7 to be the radially outward end, the ears 73, 75, 77 and 79 are displaced somewhat from the bushing outward surface and again may engage corresponding recesses in the body portion to prevent movement of the bushing relative to that body portion.

While depicted in several forms the bushing or sleeve of the present invention has numerous features common to several of those forms. Thus, for example, all bushings depicted have generally rectangular inner and outer cross sections in a direction perpendicular to the radial direction of movement of the abrasive element and corresponding expander plate. Each bushing comprises a one piece molded structure having four interconnected wall portions extending generally parallel to one another with at least three of those wall portions being substantially flat. FIGS. 4 through 7, the only bushings provided with ears, would typically be inserted into the honing tool from the center outwardly so as to engage corresponding honing tool body recesses and, of course, those ears extend away from the bushing generally perpendicular to the wall portion from which they extend. Nylon is a preferred material for molding the bushing or sleeve due to its dimensional stability when molded and due to the fact that nylon does not tend to swallow the grains of abrasive material yet does pick up some, for example, cast iron from the workpiece with these cast iron particles providing a more wear resistant surface. In each bushing illustrated, the frictional force between the bushing and its pertaining abrasive element exceeds the centrifugal force experienced by that abrasive element therefore holding the abrasive element in the desired position until the plunger is actuated to force the expander plate and therefor the abrasive element outwardly to compensate for wear and the like. In the bushing illustrated in FIGS. 5, 6, 7 and 8 at least one of the inner and outer generally rectangular cross sectional configurations deviates from a perfect rectangle to further increase the frictional force on the abrasive element.

From the foregoing it is now apparent that a novel honing tool and honing tool insert has been presented meeting the objects, advantages and features set out hereinbefore as well as others. Further, it is contemplated that changes as to arrangements, details and structural configurations which have been presented to illustrate the invention in one form thereof may be made by those skilled in the art without departing from the spirit of the invention or the scope thereof which is set out in the claims which follow.

What is claimed is:

1. In a honing tool having a generally cylindrical body portion provided with a plurality of longitudinally extending outwardly opening radial slots, an abrasive element formed entirely of abrasive material disposed in each of said slots, a like plurality of expander plates adjacent to but unconnected with the corresponding abrasive elements, carried by the body and projecting radially outwardly with the outer end portions thereof being disposed in the slots and engaging respective abrasive elements, and means for selectively urging all the expander plates and therefor also the abrasive elements simultaneously radially outwardly and into engagement with a workpiece, an improved means for mounting and retaining individual abrasive elements in their respective slots comprising a bushing supported against radial movement in the body portion within the slot and extending radially to simultaneously girdle at least a portion of the abrasive element and at least a portion of the pertaining expander plate with the abrasive element being supported for radial movement relative to the bushing and being retained therein by frictional engagement between the abrasive element and the bushing.

2. The improvement of claim 1 wherein the bushing has a uniform cross section throughout its radial extent.

3. The improvement of claim 1 wherein the said bushing is a one piece insert molded of a thermoplastic material.

4. The improvement of claim 3 wherein the thermoplastic material is nylon.

5. The improvement of claim 1 wherein when the tool is in use and rotated about the axis of the cylindrical body an abrasive element experiences centrifugal force less than the frictional force between that element and the pertaining bushing.

6. The improvement of claim 1 wherein the bushing has generally rectangular inner and outer cross section configurations in a plane perpendicular to the direction of radial extension.

7. The improvement of claim 6 wherein the abrasive elements are held in their pertaining bushings during rotation of the tool about the cylindrical axis solely by the frictional force between the bushing and the corresponding abrasive elements.

8. The improvement of claim 7 wherein the frictional force between the bushing and pertaining abrasive element is at least in part due to variation of the said bushing interior cross section from an exact rectangle.

9. The improvement of claim 8 wherein the variation is caused by at least one rib extending radially along the bushing.

10. The improvement of claim 8 wherein the bushing comprises four interconnected wall portions extending generally parallel to one another in the radial direction, three of the wall portions being substantially flat and the fourth wall portion being resiliently bowed inwardly to securely grip the abrasive element.

11. The improvement of claim 1 wherein the bushing comprises four interconnected wall portions extending generally parallel to one another in the radial direction.

12. The improvement of claim 1 wherein the bushing is fixed to the body portion by at least one threaded fastener passing through the body and into the bushing in a direction generally parallel to the axis of the cylindrical body.

13. The improvement of claim 1 wherein the bushing is provided with at least one lip for engaging at least one corresponding recess in the body portion and when thus engaged to prevent radially outward movement of the said bushing relative to the body portion.

* * * * *